US010160255B2

(12) United States Patent
Williams et al.

(10) Patent No.: US 10,160,255 B2
(45) Date of Patent: Dec. 25, 2018

(54) DISASTER SAFE DOCUMENT BINDER

(71) Applicant: Enduro Binders, Inc., Dallas, TX (US)

(72) Inventors: Patrick Williams, Dallas, TX (US); Scott Williams, Dallas, TX (US); Michael Maune, Washington, MO (US); Vincent Prejean, Little Elm, TX (US)

(73) Assignee: Enduro Binders, Inc., Dallas, TX (US)

( * ) Notice: Subject to any disclaimer, the term of this patent is extended or adjusted under 35 U.S.C. 154(b) by 1116 days.

(21) Appl. No.: 13/969,244

(22) Filed: Aug. 16, 2013

(65) Prior Publication Data

US 2014/0050517 A1 Feb. 20, 2014

Related U.S. Application Data

(60) Provisional application No. 61/684,021, filed on Aug. 16, 2012.

(51) Int. Cl.

| | |
|---|---|
| ***B42F 23/00*** | (2006.01) |
| ***B42F 13/12*** | (2006.01) |
| ***B42F 15/00*** | (2006.01) |

(52) U.S. Cl.

CPC ..... *B42F 23/00* (2013.01); *B42F 13/12* (2013.01); *B42F 15/007* (2013.01); *B42P 2241/20* (2013.01)

(58) Field of Classification Search

CPC ..... B42F 23/00; B42F 15/007; B42F 13/12; B42P 2241/20

USPC ..... 281/3.1, 15.1, 29, 30, 31, 44, 45; 283/60.1, 60.2, 64.1; 402/73, 74, 75

See application file for complete search history.

(56) References Cited

U.S. PATENT DOCUMENTS

| | | | | | |
|---|---|---|---|---|---|
| 2,164,967 | A * | 7/1939 | Unger | B42F 13/12 | 402/62 |
| 2,668,542 | A * | 2/1954 | McVean | B42F 13/30 | 402/29 |
| 2,784,719 | A * | 3/1957 | Panfil | B42F 13/00 | 402/47 |
| 5,874,374 | A * | 2/1999 | Ong | B82Y 30/00 | 423/111 |
| 6,127,040 | A * | 10/2000 | Grobbauer | H01G 2/12 | 427/100 |
| 2008/0131194 | A1 * | 6/2008 | Williams | B42D 3/045 | 402/73 |

* cited by examiner

*Primary Examiner* — Justin V Lewis

(57) ABSTRACT

A disaster-safe document binder includes rigid frame components: a front cover panel, a back cover panel, a spine assembly, and an apron. The rigid frame components form a book-like structure sized to store documents. The spine assembly includes a plurality of mounting rods that extend across the width of the spine assembly and are removably and rotatably coupled to each support member of spine assembly. The mounting rods physically support documents hanging vertically downward from the linear mounting brackets. The spine assembly includes a locking bar or locking pin that slides within a channel of a support member of the spine assembly to release or close the mounting rods within the spine assembly. The disaster-safe document binder formed from a metal that will not rust, emit harmful gases, or stain or discolor documents contained therewithin. The disaster-safe document binder is sealed closed to control an internal micro-climate within the binder.

21 Claims, 6 Drawing Sheets

DISASTER SAFE DOCUMENT BINDER

CROSS REFERENCE TO RELATED APPLICATIONS AND CLAIM OF PRIORITY

The present application claims priority under 35 U.S.C. § 119(e) to the subject matter of U.S. Provisional Patent Application Ser. No. 61/684,021 entitled "DISASTER SAFE DOCUMENT BINDER," filed on Aug. 16, 2012. The content of the above identified patent documents is incorporated herein by reference.

TECHNICAL FIELD

The present application relates generally to sheet document storage and, more specifically, to a system for preserving the integrity of documents and protecting the documents from catastrophic event damage.

BACKGROUND

Documents, plats, and materials of various types are typically maintained in document repositories or archives in many different locations around the world. For example, one common situation where such original documents are typically maintained is in county recorder or county clerk offices. Such offices function to preserve and provide for the public a true and reliable, readily accessible and permanent account of real property and other official records and vital human events, both historic and current. Documents recorded in such offices become part of the public records in the particular localities served by such offices. Many different types of documents and/or other materials can also be recorded to provide the public with notice of chain of title or other interest in real property.

Although such documents are often imaged and saved, either digitally or on film, it is beneficial to maintain original versions of the documents. In some locations, clerk and/or recorder offices are required to maintain original documents under applicable law or other governmental rule or regulation. Thug, at any given time, county clerk and/or recorder offices can house a large number of original documents.

SUMMARY

A disaster-safe document binder is provided. The disaster-safe document binder includes a first cover panel comprising a self-extinguishing material. The disaster-safe document binder also includes a second cover panel comprising a fire resistant self-extinguishing material. The disaster-safe document binder includes a spine assembly disposed between the first cover panel and the second cover panel. The spine assembly is rotatably coupled to each of the first cover panel and the second cover panel. The disaster-safe document binder includes an apron extending along a lower surface of the first cover panel from a first end of the spine assembly to a second end of the spine assembly. Further, the disaster-safe document binder includes a plurality of linear mounting rods coupled to the spine assembly and configured to physically support documents hanging vertically downward from the plurality of linear mounting brackets. The disaster-safe document binder includes a locking bar configured to secure the plurality of linear mounting rods in a closed position. A micro-climate environment is formed when the disaster safe document binder is in the closed position.

A disaster-safe document binder is provided. The disaster-safe document binder includes: a first and a second cover panel, each comprising a non-flammable self-extinguishing material. The disaster-safe document binder includes a spine assembly disposed between the first cover panel and the second cover panel. The spine assembly is rotatably coupled to each of the first cover panel and the second cover panel. The disaster-safe document binder includes an apron extending along a lower surface of the first cover panel from a first end of the spine assembly to a second end of the spine assembly. The disaster-safe document binder further includes a plurality of linear mounting rods coupled to the spine assembly and configured to physically support documents hanging vertically downward from the plurality of linear mounting brackets. Also, the disaster-safe document binder includes a locking pin configured to secure the plurality of linear mounting rods in a closed position. A micro-climate environment is formed when the disaster safe document binder is in the closed position.

A spine assembly for releasably binding documents within a binder is provided. The spine assembly includes a mounting rod having a pierced first end and a pierced second end. The mounting rod includes a single piece "U" channel mounting bracket configured to receive the mounting rod across the "U" channel and mechanically couple to the first and second ends of the mounting rod. The "U" channel mounting bracket includes a bottom, a first support member, and a second support member. The first support member is oriented substantially perpendicular to the bottom on a first side of the bottom. The first support member includes a first channel parallel to the "U" channel. The first support member includes a first slot configured to receive the first end of the mounting rod. The second support member is oriented substantially perpendicular to the bottom on another side of the bottom opposite the first side. The second support member includes a second channel parallel to the "U" channel. The second support member includes a second slot configured to receive a second end of the mounting rod. The first and the second support members are configured structurally support weight applied to mounting bracket. The spine assembly includes a locking assembly configured to slidably receive one of: a locking pin and a locking bar within the first channel of the first support member and through the pierced first end of the mounting rod, thereby mechanically coupling the mounting bar to the "U" channel mounting bracket.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A; B; C; A and B; A and C; B and C; and A and B and C. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged document storage system.

Documents, plats, and materials of various types are typically maintained in document repositories or archives in many different locations around the world. Although such documents are often imaged and saved, either digitally or on film, it is beneficial and at times mandated by government to maintain original versions of the documents.

Regardless of the particular reasons for maintaining original documents, in virtually all cases the owner, custodian or possessor of such documents (including, county clerks and other similar officials) must be concerned with protecting such documents from damage, while still permitting access to such documents. While stored documents can be subject to gradual deterioration over time, such documents can also suffer damage from relatively sudden catastrophic events. Such catastrophic events include fires, floods, wind-storms and/or natural disasters.

In most cases, county clerks and other similar officials store and maintain documents in large book-like binders; such binders provide a basic containment structure for the documents, while allowing for convenient access to such documents. Unfortunately, existing binding devices do not provide necessary protection for documents contained therein, and do not protect documents against the damaging effects of catastrophic events.

Embodiments of the present disclosure illustrate a disaster-safe document binder that is a rigid, fire and water-resistant binder and beneficially sized to accommodate documents, plats and/or other materials to be maintained therein. That is, the disaster-safe document binder 100 is sized to accommodate a specified sheet count of the documents, plats and/or other materials to be maintained therein. In addition, the disaster-safe document binder 100 is dimensioned to accommodate a specified size of the documents, plats and/or other materials to be maintained therein. The disaster-safe document binder 100 includes a micro-climate environment and is configured to limit an air gap between panels of the disaster-safe document binder and sheets stored therein. In certain embodiments, the binder 100 includes a rigid frame having substantially planar front and back cover assemblies. The front and back cover assemblies are connected to a spine assembly using at least one hinge assembly. The front and back cover assemblies and spine assembly cooperate to form a structure defining a book block. The book block is beneficially sized to accommodate documents, plats or other materials contained within the binding apparatus.

Figure 1:
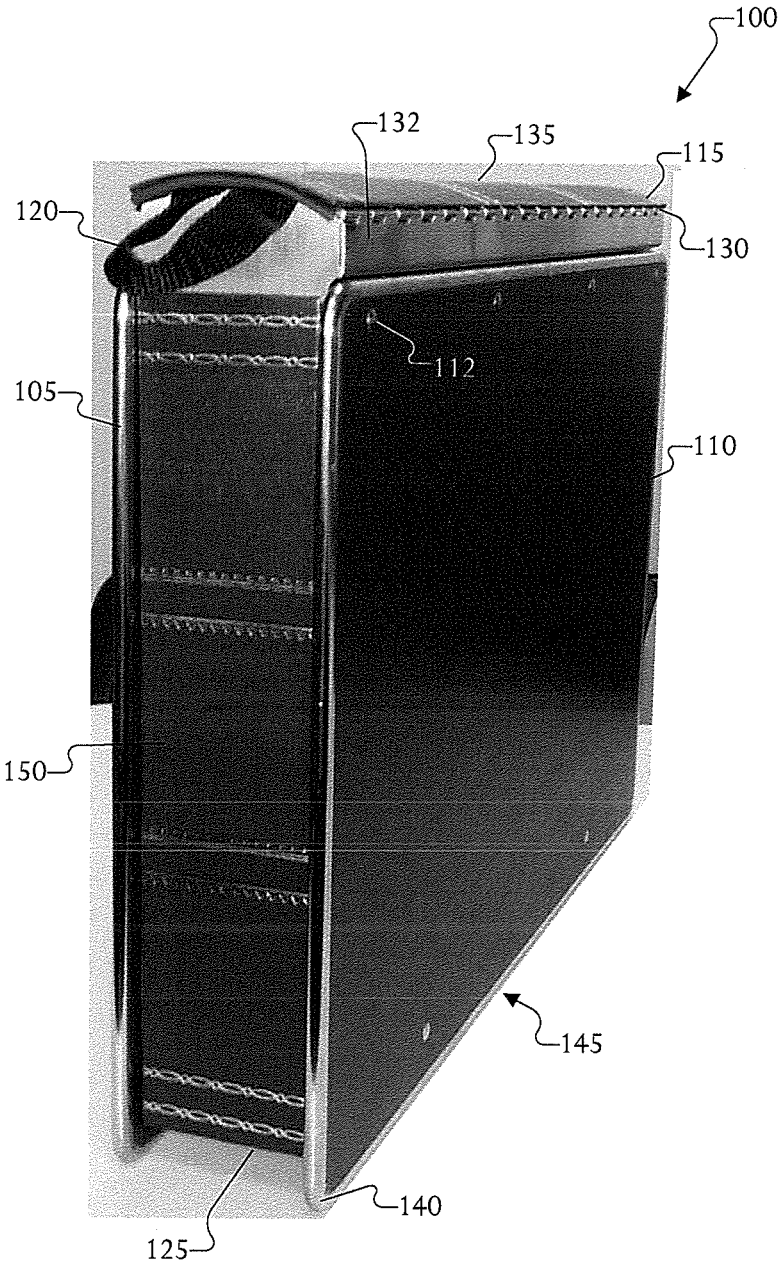
FIG. 1 illustrates a disaster-safe document binder according to embodiments of this disclosure.

FIG. 1 illustrates a disaster-safe document binder according to embodiments of this disclosure. The disaster-safe document binder 100 of FIG. 1 is configured to store a plurality of documents, plats and/or other materials (hereinafter "documents") and provide fire retardant and water resistant micro-climate environment for protection and preservation of the documents. Although certain details will be provided with reference to the components of the disaster-safe document binder 100 of FIG. 1, it should be understood that other embodiments may include more, less, or different components. The disaster-safe document binder 100 comprises a book-like form and includes a left panel 105, a right panel 110, a spine assembly 115, a retrieval handle 120, and an apron 125. For example, the front cover assembly can include the right panel 110, and the back cover assembly can include the left panel 105.

The left panel 105 and right panel 110 are each rotatably coupled to the spine assembly 115 by a hinge 130. More particularly, the left panel 105 and right panel 110 are each coupled to a leaf 132 of the hinge 130 by a mechanical connection (for example, by a rivet or weld connection 112). The leaf 132 includes hinge knuckles through which a hinge pin is inserted, permitting the leaf to revolve around the hinge pin. In certain embodiments, the hinge 130 is a piano hinge (also referred to as a continuous hinge) or any suitable hinge that extends the length of the spine assembly 115. For example, the left panel 105 is coupled to a left side portion of the spine assembly 115 by a first hinge 130 and the right panel 110 is coupled to a right side portion of the spine by another hinge 130. The coupling of each panel 105, 110 to the spine assembly 115 through the hinges 130 enables the disaster-safe document binder 100 to be opened into a flat position (see FIG. 2A) to allow easy access to the documents stored therein. That is, the hinge leaf 132 and the other hinge leaf of the hinge 130 can open to an angle of 180 degrees.

In certain embodiments, the piano hinge is a one-fourth of an inch (¼ inch) piano hinge with a hinge pin having diameter of substantially ¼ inch. In certain embodiments, the piano hinge is a three-eighths of an inch (⅜ inch) piano hinge with a hinge pin having diameter of substantially ⅜ inch. In certain embodiments, the piano hinge is a one-eighth of an inch (⅛ inch) piano hinge having a hinge pin diameter of substantially ⅛ inch. In certain embodiments, the spine assembly 135 comprises a piano hinge that has knuckles that are ½ inch in length. The piano knuckles of each hinge leaf are spaced substantially ½" apart from each other, such that when the two hinge leaves interlace, the end play of the hinge 130 less than 1 millimeter. The piano hinge is coupled to, such as by one or more rivets or welds, the mounting bracket 205 of the spine assembly 115.

The left panel 105 and right panel 110 each include a self-extinguishing core material covered by a non-flammable material. That is, the self-extinguishing core material ceases burning once the source of the flame has been removed. In certain embodiments, the self-extinguishing core material is dimensioned to be ¼" thick. In certain embodiments, the self-extinguishing core material is dimensioned to be ⅜" thick with a perimeter framed edge routed ¼" thickness. In addition, the non-flammable material includes a flame retardant material or flame resistant material adhered to the self-extinguishing core material. The non-flammable material is configured to inhibit or resist the spread of fire. In the certain embodiments, one or more of the flame resistant, flame retardant and self-extinguishing materials meet applicable professional specifications such as, for example, National Fire Protection Association (NFPA) Code Class 1. In certain embodiments, the non-flammable material can withstand temperatures from direct flames above 2000 degrees Fahrenheit. Such material can be treated to meet NFPA 701, NFPA 260 and Cal 117-F. An outer covering material is affixed to the non-flammable material. The outer material can be aesthetically pleasing and, if desired, designed to resemble the outer surfaces of conventional binder assemblies. In certain embodiments, the outer surface of the non-flammable material is aesthetically pleasing and designed to resemble the outer surfaces of conventional binder assemblies. In certain embodiments, left panel 105 and right panel 110 each can be composed of an Inert Polymer.

In certain embodiments, the spine assembly 115 includes a labeling spine 135. The labeling spine 135 is mechanically affixed to the spine assembly 115. For example, the labeling spine 135 can be affixed to the spine assembly 115 through a screw connection (for example, the riveted bracket and screw shown in FIG. 6B), a hook and loop connection, a tab and slot connection or a rivet connection. The labeling spine 135 includes stainless steel, a non-ferrous metal, a self-extinguishing core material covered by a non-flammable material, or combination thereof. The labeling spine 135 also includes one or more of symbols and text that identify the content of the disaster-safe document binder 100 or are otherwise aesthetically pleasing. In certain embodiments, the labeling spine 135 is covered by a non-flammable material, such as the type of material that covers the self-extinguishing core of left panel 105 and the right panel 110.

In certain embodiments, the spine assembly includes a pull loop retrieval handle 120. The pull loop retrieval handle 120 is a durable, fold resistant material configured to enable retrieval of the disaster-safe document binder 100 from a shelf or container. For example, the pull loop retrieval handle 120 can be formed from a Nylon or polypropylene material. The pull loop retrieval handle 120 is mechanically coupled to the spine assembly 115, such as by one or more rivets (shown in FIG. 5C).

The disaster-safe document binder 100 includes a protective rim 140. In certain embodiments, the protective rim 140 is configured to inhibit damage to the panels 105, 110. Also, the protective rim 140 is configured to avoid being accidentally removed (i.e., ripped off) by surrounding an edge of each of the panels 105, 110. For example, a first protective rim 140 is disposed completely around a circumferential edge of the left panel 105. In addition, a second protective rim 140 is disposed completely around a circumferential edge of the right panel 110. That is, each of the front cover assembly and the back cover assembly includes a protective rim 140. The protective rim 140 is configured to provide additional structural strength and stability to the disaster-safe document binder 100. For example, since the disaster-safe document binder 100 is configured to be stored with the spine assembly 115 in the uppermost position (i.e., the spine facing upward), the protective rim 140 is configured to provide a vertical strength to disaster-safe document binder 100. The protective rim 140 is also configured to provide strength when/if the disaster safe document binder is dropped. In certain embodiments, the protective rim 140 is formed from a material that includes a low friction coefficient. For example, the protective rim 140 is formed from any suitable material such as one or more metals including stainless steel. In certain embodiments, the protective rim 140 is formed from aircraft aluminum coated with an electroceramic coating, such as ALODINE $EC^2$. Accordingly, the protective rim 140 enhances an easy retrieval of the disaster-safe document binder 100 from a shelf or storage container.

The disaster-safe document binder 100 is configured to be stored in a vertical oriented position. That is, when in a stored position (i.e., the vertical oriented position), the spine assembly 115 is oriented in the upper most position such that the spine assembly 115 faces upward and a lower edge 145 of the disaster-safe document binder 100 is in physical contact with the supporting surface, such as a shelf. The vertical oriented position enables documents stored in the disaster-safe document binder 100 to hang downward in a stress reduced manner from a mounting bracket.

The apron 125 is affixed to the right panel 110. The apron 125 extends along an inner surface of the right panel 110. In a vertical oriented position, the apron 125 includes two vertical portions that extend vertically downward from both ends of the spine assembly 115 toward the lower edge 145 of the disaster-safe document binder. That is, each vertical portion extends vertically downward from a respective ends of the spine assembly 115 toward the lower edge 145 of the disaster-safe document binder. Also in the vertical oriented position, the apron 125 includes a horizontal portion that extends horizontally across the length of the right panel 110, parallel with the lower edge 145, connecting the two vertically extended portions of the apron 125. In certain embodiments, the two vertical portions and the horizontal portion of the apron form a single unit, not a combination of piecemeal components. In certain embodiments, the apron 125 comprises a single sheet of material, bent (substantially 90 degrees) at each end of the lower edge 145. The vertical portions of the apron 125 include an expanded portion adjacent to the spine assembly 115 and oriented to be substantially perpendicular to the spine assembly 115 when the disaster-safe document binder 100 is in a closed position. The apron 125 is configured to couple to the spine assembly 115 when the disaster-safe document binder 100 is in a closed position. That is, the shape of the expanded portion of the apron 125 that is adjacent to the spine assembly 115 complements the shape of the spine assembly 115. The apron 125 is formed of a suitable non-rusting material, such as a non-ferrous material. For example, the apron 125 can be constructed of stainless steel because stainless steel will not rust, emit harmful gases, or stain or discolor documents contained within said frame.

In certain embodiments, the apron 125 includes a labeling panel 150. The labeling panel 150 is mechanically affixed to a front portion of apron 125 such that the label is outward facing when the disaster-safe document binder 100 is in a stored position, such as on a shelf. For example, the labeling panel 150 can be affixed to the apron 125 through a hook and loop connection, a tab and slot connection, or a rivet connection. The labeling panel 150 includes a self-extinguishing core material. In certain embodiments, the labeling panel 150 includes a non-flammable material, such as the material covering the self-extinguishing core of the left and right panels 105, 110. The labeling panel 150 also includes one or more of symbols and text that identify the content of the disaster-safe document binder 100 or are otherwise aesthetically pleasing.

Figure 2A:
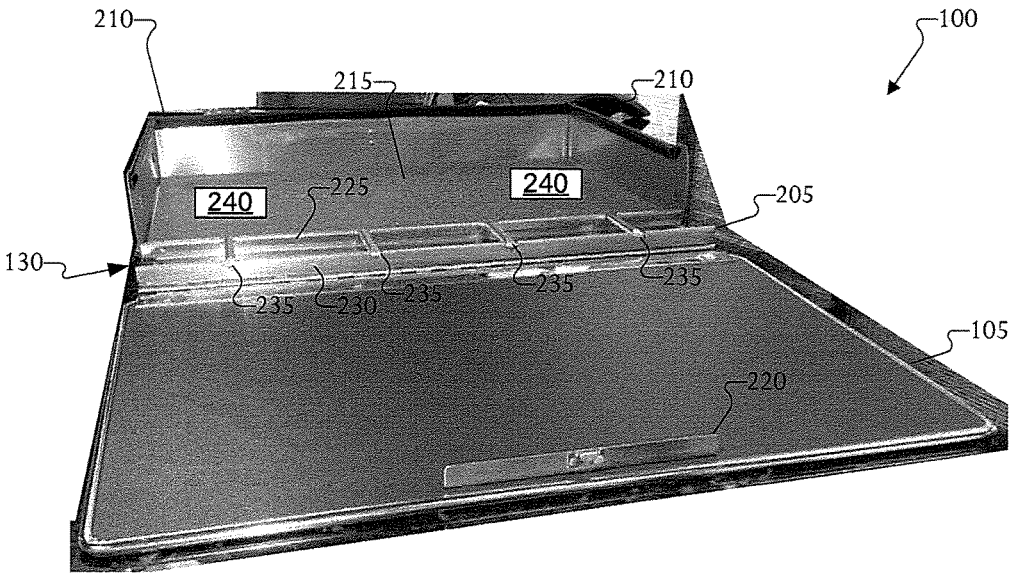
FIGS. 2A and 2B illustrate perspective views of the disaster-safe document binder according to an embodiment of this disclosure.
Figure 2B:
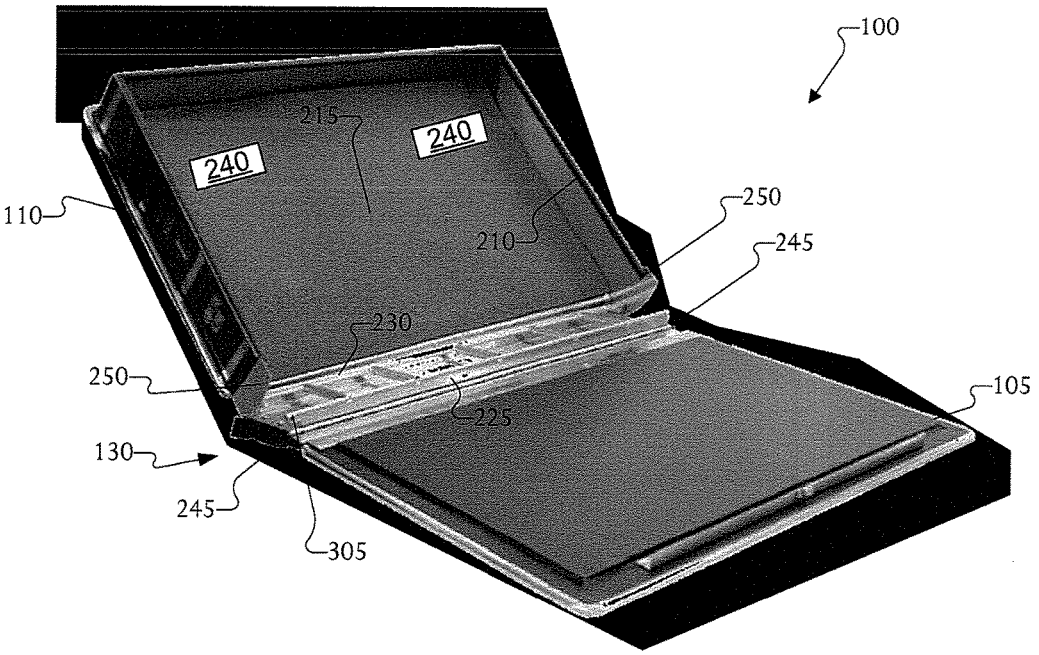

FIGS. 2A and 2B illustrate perspective views of the disaster-safe document binder according to an embodiment of this disclosure. Although certain details will be provided with reference to the components of the disaster-safe document binder 100 of FIGS. 2A and 2B, it should be understood that other embodiments may include more, less, or different components. The disaster-safe document binder 100 includes a mounting bracket 205, a compression seal 210, a compression material 215 and a latching member 220.

The left panel 105 and right panel 110 are configured to rotate from a closed position in which the left panel 105 is in physical contact with the apron 125 to an open position as shown in the example illustrated in FIGS. 2A and 2B. For example, when the disaster safe document binder 100 is laid horizontally on a table, the right panel 110 is the top panel and is the panel that rotates to the open position. For example, the right panel 110 is the front cover panel and the left panel 105 is the back cover panel. In addition, the spine assembly 115 is configured to rotate via a hinge 130 from a closed position in which the spine assembly 115 is in physical contact with the apron 125 to an open position as shown in the example illustrated in FIGS. 2A and 2B. Accordingly, when in an open position, the disaster-safe document binder 100 is configured to be in a flat position to allow easy access to the documents stored therein.

The spine assembly 115 includes the mounting bracket 205 that provides a frame or structural support for the components mechanically coupled to the mounting bracket 205. In certain embodiments, the mounting bracket 205 provides a frame or structural support for the components mechanically coupled to the spine assembly 115. In certain embodiments, the mounting bracket 205 can be mechanically adhered to the labeling spine 135 of the spine assembly 115, such as by a weld, rivet, tab and slot, or screw connection. In certain embodiments, the mounting bracket 205 includes a "U" channel riveted to the labeling spine 135 of the spine assembly 115. The one piece "U" channel can be coupled to the labeling spine 135 by a weld, tab and slot, or screw connection. The mounting bracket 205 is made of any suitable material, such as a non-rusting, non-ferrous metal (for example, aluminum) or stainless steel. The mounting bracket 205 includes a first support member 225 and a second support member 230. In certain embodiments, the mounting bracket 205 is a single element molded to form a "U" shape and includes a flat bottom to which the first support member 225 and second support member 230 are oriented perpendicular. For example, the "U" channel can be formed from a single element, such as a single sheet of non-ferrous alloy, aluminum, or stainless steel. That is, the mounting bracket is formed from a single element as opposed to multiple separate pieces. The single element is molded into the shape of the "U" channel.

The mounting bracket 205 also includes any number of linear mounting rods 235 that extend across a width of the mounting bracket 205 from the first support member 225 to the second support member 230. The linear mounting rods 235 are removably coupled to the first support member 225. The mounting rods 235 are rotatably coupled to the second support member 230. In certain embodiments, the mounting rods 235 are removably and rotatably coupled to one or both of the first support member 225 and the second support member 230. In certain embodiments, the mounting rods 235 include a cylinder shape and an elongated form (i.e., having notably more length than width; being long and slender). The linear mounting rods 235 are configured to pass through apertures in mounting pages, which hold the documents stored in the disaster-safe document binder 100.

The compression material 215 is disposed along the inner surface of the right panel 110, in an area formed between spine assembly 115 and the apron 125. In certain embodiments, the compression material 215 covers the entire interior surface of the right panel 110. The compression material 215 is configured to limit an air gap between stored documents and the disaster-safe document binder 100. That is, the compression material 215 occupies a space between a first stored document and the inner surface of the right panel 110. The compression material 215 provides physical support to the contents of disaster-safe document binder 100 when the disaster-safe document binder 100 is closed. Moreover, the compression material 215 can conveniently and beneficially provide a support media for silica gel 240 or other additives that can help control the micro-climate within the disaster-safe document binder 100 when the disaster-safe document binder 100 is in a closed position. The compression material 215 also permits easy grasping of contents stored or maintained within the disaster-safe document binder 100. The compression material resists folding or buckling of the documents stored within the disaster-safe document binder 100. The compression material 215 can be any suitable material designed to compress in response to pressure from the stored documents. For example, the compression material 215 can be constructed from an inert material that is fire resistant, such as a foam. In certain embodiments, the foam is 100% polyester. The compression material 215 provides support to the documents stored within the disaster-safe document binder 100. The compression material 215 occupies space between the document (for example, mounting pages) and the right panel 110. The compression material 215 allows the documents to be easily grasped by a user. In certain embodiments, the surface texture of the compression material 215 less smooth than the surface texture of the mounting pages or documents, thereby helping a finger of the user to maintain contact with an edge of a mounting page or document during a lift motion. The compression material 215 resists folding and damage of documents. For example, a user's touch can compress the compression material 215 surrounding an edge of a mounting page or document, enabling the user's finger to slide under the mounting page or document without bending or folding the mounting page or document. As a result, the user may lift the mounting page or document without bending or folding the corner or edge of the mounting page or document.

The compression seal 210 is configured to inhibit air, moisture, and particulate matter from moving in and out of the disaster-safe document binder 100 when the disaster-safe document binder 100 is in a closed position. The compression seal 210 can be constructed from a weather stripping material or gasket material such as a bulb gasket. The compression seal 210 is a compressible material configured to create a seal between the apron 125 and an inner surface of the left panel 105. Additional compression seals 245 are included at opposite ends of the spine assembly 115. The compression seals 245 are compressible materials configured to create a seal between the expanded portions 250 of the apron and the spine assembly 115. In certain embodiments, the compression seals 245 are chemically adhered or mechanically coupled to the spine assembly 115. For example, in the example shown in FIG. 6A, the compression seals 245 is chemically adhered or otherwise coupled to the labeling spine 135.

The compression seal 210 and compression seals 245 also promote an internal micro-climate within the rigid frame of the disaster-safe document binder 100. The compression seals 210, 245 resist penetration of water, air, and particulate matter into the micro-climate within the disaster-safe document binder 100. When the disaster-safe document binder 100 is closed and sealed, the micro-climate environment (including relative humidity and atmospheric pollutants) within the disaster-safe document binder 100 can be beneficially regulated. The micro-climate can be regulated using existing products, such as MICROCHAMBER Barrier Boards and Buffered Silica Gel. Controlling the interior environment within the disaster-safe document binder 100 protects the contents situated therein, and inhibits the growth of mold during and after disasters. Inhibiting the of mold can be especially beneficial when HVAC systems are not functioning for prolonged periods such as, for example, during power outages caused by natural disasters.

The latching member 220 is disposed at an outer portion of the inner surface of the left panel 105. In certain embodiments, latching member 220 forms a planar surface that is oriented substantially parallel to the apron 125 (and spine assembly 115) when the disaster-safe document binder 100 is oriented in a closed position. A latch assembly, which is disposed on a lower side of the apron 125, is configured to engage with latching member 220 to selectively secure disaster-safe document binder 100 in a closed position. The latch assembly retains the binder 100 the closed position in the event of an abrupt impact with a hard surface, such as by dropping the disaster-safe document binder 100 onto a floor.

In certain embodiments, one or both of the first support member 225 and second support member 230 includes a locking mechanism. The locking mechanism is configured to lock and restrain a locking pin, or locking bar if so configured, in the closed position. The locking mechanism can include a threaded via in the support member 225, 230 adapted to couple to a locking bolt or locking screw. The locking mechanism and locking pin (or locking bar) from a locking assembly configured to inhibit removal of stored documents.

Figure 3A:
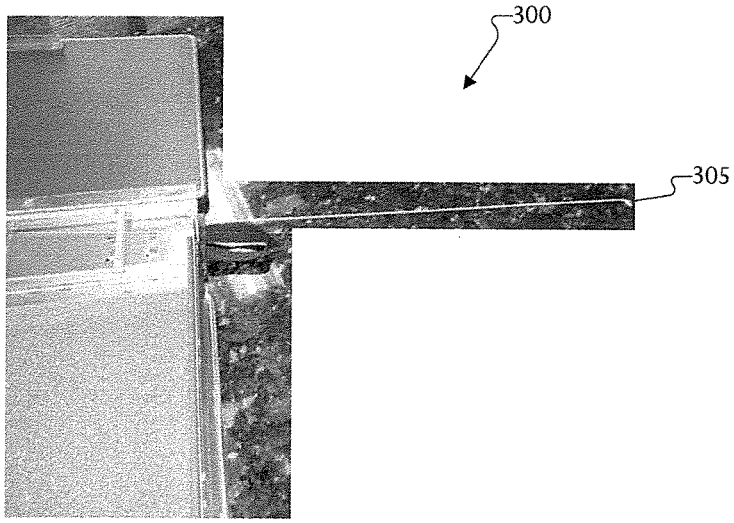
FIG. 3A illustrates a locking pin assembly according to an embodiment of this disclosure.

FIG. 3A illustrates a locking pin assembly 300 according to an embodiment of this disclosure. Although certain details will be provided with reference to the components of the disaster-safe document binder 100 of FIG. 3A, it should be understood that other embodiments may include more, less, or different components. In certain embodiments, the disaster-safe document binder 100 includes a mounting bracket 205 with a locking pin 305. That is, the spine assembly 115 includes the mounting bracket 205 and locking pin assembly 300.

The locking pin 305 is configured to be inserted into the first support member 225 and through one end of the linear mounting rods 235. While inserted, the locking pin 305 couples the linear mounting rods 235 to the mounting bracket 205.

Figure 3B:
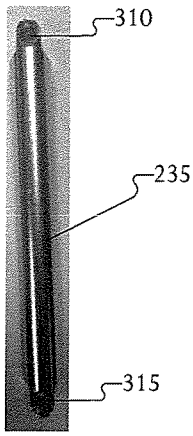
FIG. 3B illustrates a linear mounting rod according to embodiments of the present disclosure.

FIG. 3B illustrates a linear mounting rod 235 according to embodiments of the present disclosure. Each linear mounting rod 235 includes an opening, or via (also referred to as a piercing), at opposite ends of the linear mounting rod 235. A first opening 310 is adapted to rotatably couple the linear mounting rod 235 to the first support member 225. The second opening 315 aligns with a channel inside the second support member 230. A second locking pin 305 is inserted through the second support member 230 channel and the second openings 315 of each of the linear mounting rods 235. When inserted, the locking pin 305 secures the linear mounting rods 235 in a closed position. In the closed position, the linear mounting rods 235 are parallel to the spine assembly 115. When removed or decoupled from one support member 230, the linear mounting rods 235 are free to rotate around a pivot point disposed at the first support member 225.

In certain embodiments, a locking pin 305 is inserted through the first support member 225 channel and the first openings 310 of each of the linear mounting rods 235. When inserted, the locking pin 305 secures the linear mounting rods 235 in a closed or rotating position. In the closed or rotating position, the linear mounting rods 235 are able to rotate about a pivot point created by the coupling of the locking pin 305 and the first openings 310 of each of the linear mounting rods 235. When the locking pin 305 at the first support member 225 is removed, the linear mounting rods 235 are free to rotate around a pivot point disposed at the second support member 230 (when the locking pin 305 at the second support member 230 is in the closed position).

When in the closed positions, the linear mounting rods 235 secure the mounting pages, which contain the documents stored in the disaster-safe document binder 100, such that the mounting pages are unable to be removed from the disaster-safe document binder 100. Accordingly, the documents stored in the disaster-safe document binder 100 are restrained from moving within the disaster-safe document binder 100. Further, when the disaster-safe document binder 100 is placed in the vertical oriented position (e.g., for storage on a shelf), the mounting pages hang from the linear mounting rods 235, which are secured in a parallel orientation to the spine assembly 115. For example, the linear mounting rods 235 span across the "U" channel of the mounting bracket 205 and are secured to the mounting bracket 205. Therefore, documents (typically inserted in the mounting pages) stored in the disaster-safe document binder 100 hang stress free downward from the mounting page apertures and mounting bracket 205.

To open the mounting bracket 205, the locking pin 305 is completely removed from the first support member 225. Upon removal of the locking pin 305, the linear mounting rods 235 are able to rotate about the pivot point at the second support member 230. Therefore, one or more mounting pages may be removed by the mounting pages along the linear mounting rods 235 towards the now un-restrained end of the linear mounting rods 235.

In certain embodiments, one or both of the first support member 225 and second support member 230 includes a locking mechanism. The locking mechanism is configured to lock the locking pin 305 if so configured in the closed position. The locking mechanism 505 (shown in FIG. 5A) can include a threaded via in support member 225, 230 adapted to couple to a locking bolt or locking screw.

Figure 4A:
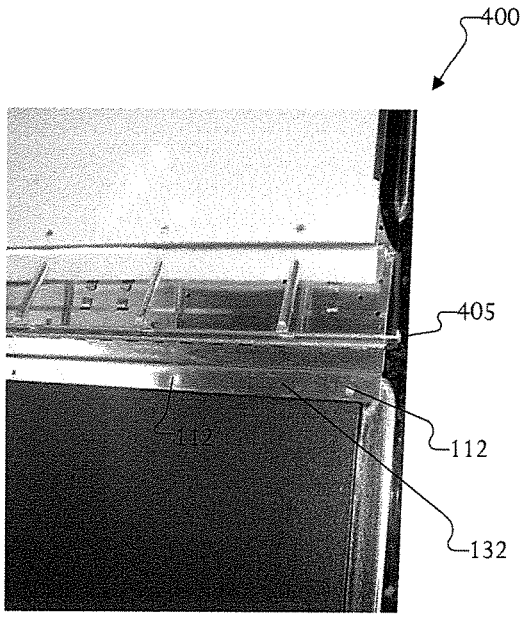
FIG. 4A illustrates a locking bar assembly according to an embodiment of this disclosure.
Figure 4B:
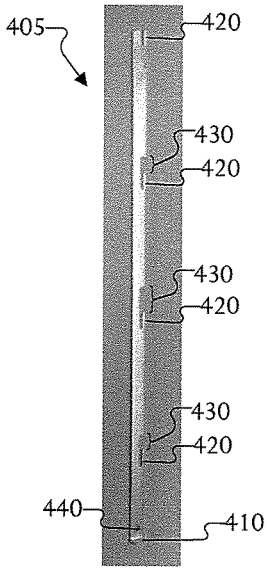
FIG. 4B illustrates a close view of the locking bar of FIG. 4A.
Figure 4C:
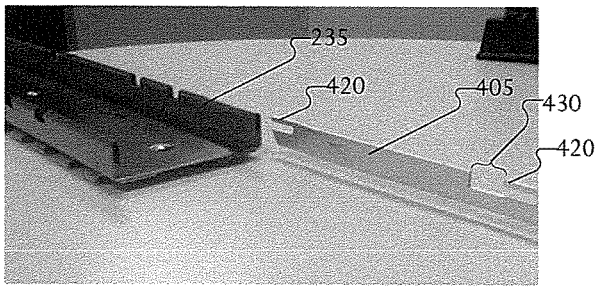
FIG. 4C illustrates an up close view of the locking bar of FIG. 4A in close proximity of a channel of a support member into which the locking bar is inserted.

FIG. 4A illustrates a locking bar assembly 400 according to an embodiment of this disclosure. FIG. 4B illustrates a close view of the locking bar of FIG. 4A. FIG. 4C illustrates an up close view of the locking bar of FIG. 4A in close proximity of a channel within a support member 225, 230 into which the locking bar is slidably inserted. Although certain details will be provided with reference to the components of the disaster-safe document binder 100 of FIG. 4A-4C, it should be understood that other embodiments may include more, less, or different components. In certain embodiments, the disaster-safe document binder 100 includes a mounting bracket 205 with a locking bar 405.

The locking bar 405 is a flat, slender bar with a bent end 410 (also referred to as a pull tab). The bent end 410 provides a place for a human finger or other object to pull the locking bar 405 into an open position or to push the locking bar 405 into a closed position. In certain embodiments, the locking bar 405 includes a bent end 410 on one end and a pivot slit 420 on the other end (shown in FIG. 4C). The pivot slit 420 is an arm shaped pivot point formed by a cutout within the locking bar 405. Each of the linear mounting rods 235 rotates around the pivot slit 420 formed within the mounting rod 235. The pivot slit 420 is configured to go through an opening 310, 315 of the mounting rod 235 as the locking bar 405 is pushed into the closed position. Each of the linear mounting rods 235 rotates around the arm shaped pivot slit 420 formed within the locking bar 405.

The locking bar 405 is configured to slide along the channel in the second support member 230. The locking bar 405 is configured to slide from a closed position to an open position. When in a closed position, portions of the locking bar 405 (for example, the pivot slit 420) are inserted or otherwise disposed within the second openings 315 of each of the linear mounting rods 235. Therefore, when in closed position, the locking bar 405 secures the linear mounting rods 235 in a closed position. In the closed position, the linear mounting rods 235 are parallel to the spine assembly 115. In the open position, the linear mounting rods 235 are free to rotate around the pivot point disposed at the first support member 225.

In certain embodiments, a locking bar 405 is configured to slide along a channel in the first support member 225. The locking bar 405 at the first support member 225 is configured to slide from a closed position to an open position. When in a closed position, portions (for example, the pivot slit 420) of the locking bar 405 are inserted or otherwise disposed within the first openings 310 of each of the linear mounting rods 235. When in the closed position, the locking bar 405 secures the linear mounting rods 235 in a closed or rotating position. In the closed or rotating position, the linear mounting rods 235 are able to rotate about a pivot point created by the coupling of the locking bar 405 and the first openings 310 of each of the linear mounting rods 235. When the locking bar 450 at the first support member 225 is in the open position, the linear mounting rods 235 are free to rotate around a pivot point (for example, the pivot slit 420) disposed at the second support member 230 (when the locking bar 405 at the second support member 230 is in the closed position).

When in the closed positions, the linear mounting rods 235 secure the mounting pages, which contain the documents stored in the disaster-safe document binder 100, such that the mounting pages are unable to be removed from the disaster-safe document binder 100. Accordingly, the documents stored in the disaster-safe document binder 100 are restrained from moving within the disaster-safe document binder 100. Further, when the disaster-safe document binder 100 is placed in the vertical oriented position (e.g., for storage on a shelf), the mounting pages hang from the linear mounting rods 235, which are secured in a parallel orientation to the spine assembly 115. Therefore, documents (typically inserted in the mounting pages) stored in the disaster-safe document binder 100 hang stress free downward from the mounting page apertures and mounting bracket 205.

To place the mounting bracket 205 in an open position (i.e., to open the mounting bracket 205), an operator slides the locking bar 405 such that the locking bar 405 only partially extends from the second support member 230. That is, the operator pulls the locking bar 405 partially out of the channel within the supporting member 225, 230, for example, by pulling the bent end 410. For example, the locking bar 405 can be limited to slide only ⅝" (i.e., ⅝ of an inch). Once the operator slides the locking bar 405 within a range of ⅜" to ⅝", the portions of the locking bar 405 previously engaged within the second openings 315 of each of the linear mounting rods 235 are disengaged from the locking bar 405, allowing the linear mounting rods 235 to rotate about the pivot point. That is, upon sliding of the locking bar 405 to the open position, the linear mounting rods 235 are able to rotate about the pivot point (for example, the pivot slit 420 of the locking rod 405 within the first support member 225) at the first support member 225. Therefore, one or more mounting pages may be removed without having to remove the locking bar 405 from the mounting bracket 205. In the open position, the disengaged (for example, released) opening 310, 315 of the linear mounting rod 235 is disposed within a disengagement void 430 formed of the cutout within the locking bar 405. The disengagement void decouples the respective openings 310, 315 of the linear mounting rods 235 that are disengaged from a respective support member 225, 230.

In certain embodiments, one or both of the first support member 225 and second support member 230 includes a locking mechanism. The locking mechanism is configured to lock the locking bar 405 in the closed position. The locking mechanism can include a threaded via 505 in a support member 225, 230 adapted to couple to a locking bolt or locking screw. The locking mechanism is described more particularly in reference to FIG. 5A.

In certain embodiments, all rigid frame components including, panels 105, 110, apron 125, spine assembly 115, hinges 130, latching member 220, latch and protective rim 140 are constructed of stainless steel. In the certain embodiments, stainless steel is used for the frame components because it will not rust, emit harmful gases, or stain or discolor documents contained within the disaster-safe document binder 100. In certain embodiments, the rigid frame components 105, 110, 115, 130, 220 and the locking pin 305 or locking bar 405 are formed from aircraft aluminum coated with ALODINE anodizing coating or an electroceramic coating, such as ALODINE EC$^2$. In certain embodiments, the locking bar 405 or the locking pin 305 is formed from aircraft aluminum coated with ALODINE anodizing coating or an electroceramic coating. When the locking pin 305 or locking bar 405 formed of aircraft aluminum is not coated with ALODINE anodizing coating nor an electroceramic coating, yet the channel in the support member 225, 230 (into which the locking pin 305 or locking bar 405 slidably inserts) is formed of aircraft aluminum coated with ALODINE anodizing coating or an electroceramic coating, a chemical reaction reduces the ease for an operator to cause the locking pin 305 or locking bar 405 to slide within the channel.

The ALODINE coating is suitable for use on aluminum, magnesium, and other non-ferrous alloys. The anodizing coating provides improved corrosion protection and paint adhesion. ALODINE anodizing coating covers chrome, non-chrome and anodizing technologies. ALODINE $EC^2$ electroceramic base coating protects aluminum, titanium, and light metal parts and related alloys in severe environment. ALODINE $EC^2$ electroceramic base coating improves efficiency across the coating process and reduces processing cost by one application level between the metal surface and decorative finish. ALODINE $EC^2$ electroceramic base coating improves performance of secondary coating and adhesives and extends the life of coated components. ALODINE $EC^2$ electroceramic base coating provides resistance against heat and abrasion and long-term corrosion protection for metals. ALODINE $EC^2$ electroceramic base coating is environmentally safe, chrome free, and Restriction of Hazardous Substances (RoHS) and End of Life Vehicle (ELV) compliant.

Figure 5A:
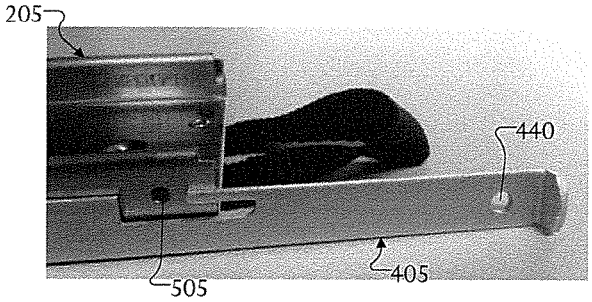
FIG. 5A illustrates a locking mechanism of a support member according to embodiments of this disclosure.

FIGS. 5A-6B illustrates the components of the spine assembly according to embodiments of this disclosure. FIG. 5A illustrates a locking mechanism of a support member according to embodiments of this disclosure. Although certain details will be provided with reference to the components of the locking mechanism, it should be understood that other embodiments may include more, less, or different components.

In the locking mechanism, a locking bolt or locking screw is configured to insert, via a screwing, twisting or pushing motion, into the threaded via 505, crossing the channel within the support member 225, 230 insofar as to collide with the internal surface of the perimeter of the channel on the other side of the channel within the support member 225, 230. The locking bar 405 includes a via 440 configured to receive the locking bolt or locking screw there through. Whether or not the locking bar 405 is inserted into the channel within the support member 225, 230, the locking bolt or locking screw remains coupled to the mounting bracket 205 within the threaded via 505. When the locking bar 405 is inserted into the closed position within the channel of the support member 225, 230, the threaded via 505 and the via 440 of the locking bar 405 align such that the locking bolt or locking screw passes through both vias by crossing the channel within the support member 225, 230. The locking bolt or locking screw through the via 440 prevents the locking bar 405 from sliding into open position.

Figure 5B:
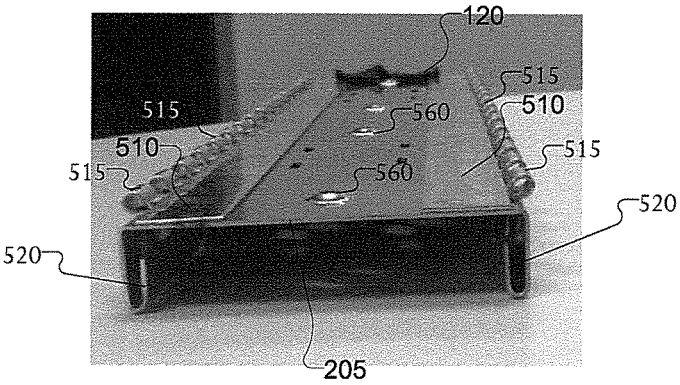
FIG. 5B illustrates two hinge leaves of the hinges and a retrieval handle mechanically coupled to the mounting bracket according to embodiments of this disclosure.

FIG. 5B illustrates two hinge leaves 510 of the hinges 130 and a retrieval handle 120, each mechanically coupled to the mounting bracket 205 according to embodiments of this disclosure. In the example shown in FIG. 5B, the hinge leaves 510 are coupled to the mounting bracket 205 by rivets. One leaf 132 of the piano hinge 130 is coupled to the left panel 105 by rivets (for example, by four rivets 112 as shown in the example of FIG. 1). The other leaf of the piano hinge 130 is coupled to the mounting bracket 205. Also shown in FIG. 5B, the mounting bracket 205 is in a vertically oriented position. Each hinge leaf 510 extends the length of the mounting bracket 205. Both hinge leaves 510 are mounted to the same surface of the mounting bracket 205, namely, the surface that does not face the interior of the disaster-safe document binder 100. Each hinge leaf 510 includes knuckles 515 configured to interlace and to align with the knuckles of the leaf 132, enabling a hinge pin to alternately pass through a knuckle of the leaf 510 and next pass through a knuckle of the leaf 132 and then through another knuckle of the leaf 510. The mounting bracket 205 includes two narrow channels 520 formed within each of the first support member 225 and the second support member 230. In certain embodiments, each narrow channel 520 is formed by folding an edge of each of the first support member 225 and the second support member 230 toward the flat bottom of the "U" channel. That is, a single piece of suitable material (e.g., non-rusting metal) forms the mounting bracket 205, the first support member 225 including a narrow channel 520, and the second support member 230 including a narrow channel 520.

Figure 5C:
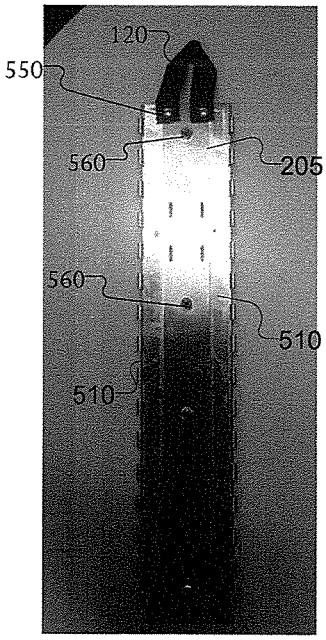
FIG. 5C illustrates the two hinge leaves of the hinges 130 and a retrieval handle mechanically coupled to the mounting bracket of FIG. 5B in an upside down vertically oriented position.

FIG. 5C illustrates the two hinge leaves 510 of the hinges 130 and a retrieval handle 120 mechanically coupled to the mounting bracket 205 of FIG. 5B in an upside down vertically oriented position. That is, the surface that faces the interior of the disaster-safe document binder 100 is facing downward. The pull loop retrieval handle 120 is mechanically coupled to the mounting bracket 205 by rivets 550.

Figure 6A:
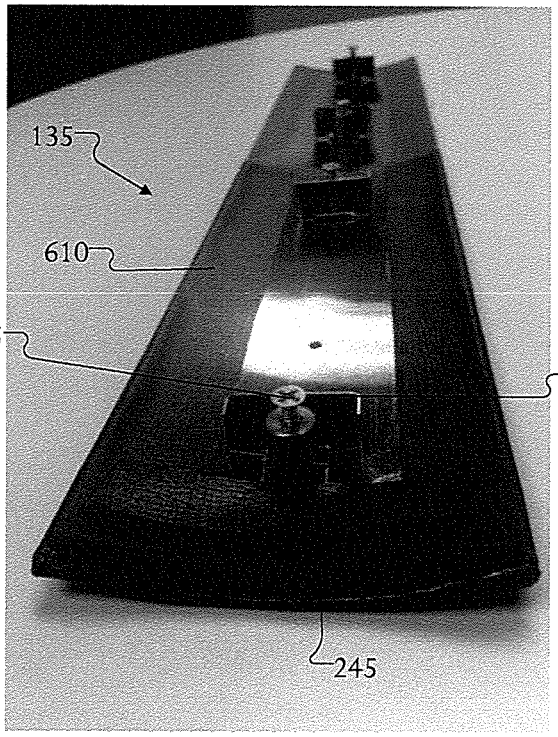
FIG. 6A illustrates a labeling spine in an upside down (spine assembly down) vertically oriented position according to embodiments of this disclosure.
Figure 6B:
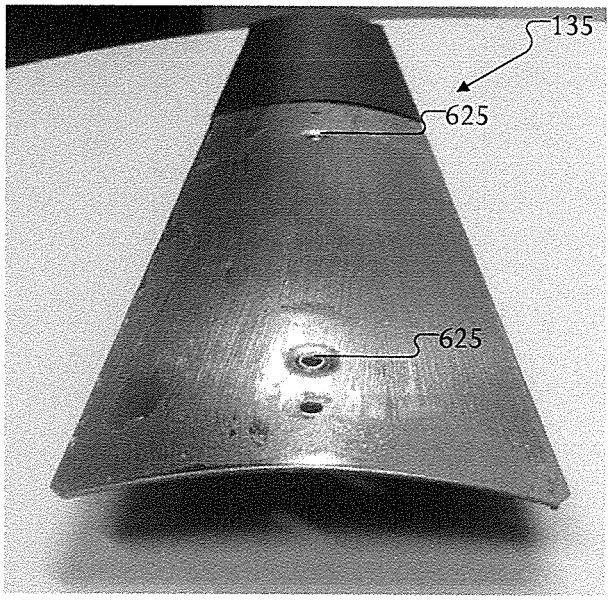
FIG. 6B illustrates a labeling spine in the vertically oriented (spine assembly up) position according to embodiments of this disclosure.

FIG. 6A illustrates a labeling spine 135 in an upside down vertically oriented position according to embodiments of this disclosure. FIG. 6B illustrates a labeling spine 135 in the vertically oriented position according to embodiments of the present disclosure. For illustration purposes, substantially half of the labeling spine 135 is covered by a non-flammable material 610. The other half of the labeling spine 135 is a non-rusting metal. In certain embodiments, the labeling spine 135 is completely covered by the self extinguishing, non-flammable material 610. In certain embodiments, the labeling spine 135 does not comprise non-flammable material 610. The labeling spine 135 is configured to be affixed to the spine assembly 115 by a screw connection to the mounting bracket 205. The head of a screw 615 inserts through a recessed hole 560 within the flat bottom of the "U" channel of the mounting bracket 205 (shown in FIGS. 5B and 5C). Then, the screw 615 is inserted into a threaded hole within the bracket 620 coupled to the labeling spine 135. When the screw 615 fully screwed into the bracket 620, the head of the screw is flush with the flat bottom of the "U" channel of the mounting bracket 205.

FIG. 6B illustrates that each of the brackets 620 of FIG. 6A is coupled to the labeling spine 135 by a rivet 625.

Figure 7:
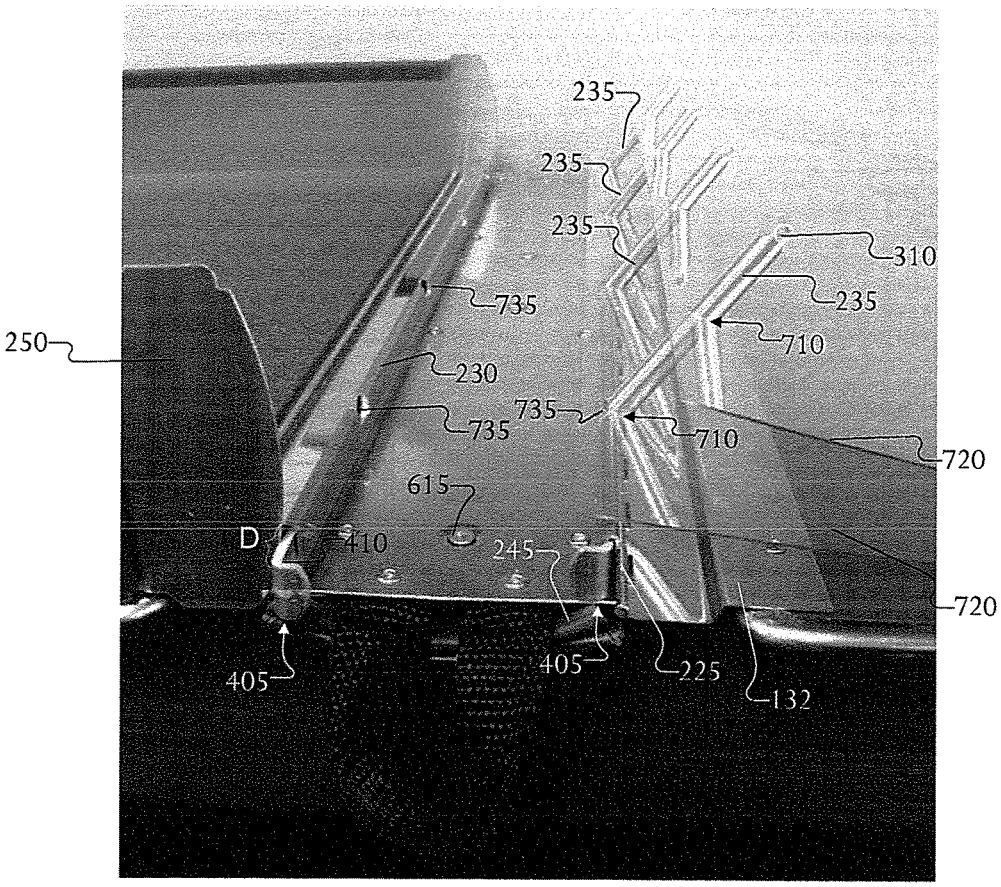
FIG. 7 illustrates mounting rods rotated to an open position according to embodiments of this disclosure.

FIG. 7 illustrates mounting rods 235 rotated to an open position according to embodiments of this disclosure. The mounting rods 235 are rotatably and removably coupled to the first support member 225 and to the second support member 230. As shown, the mounting rods have been released from the second support member 230. In a closed position (shown in FIGS. 2A and 2B), each end of the mounting rod 235 is disposed in a cutout 735 (also referred to as a recess 735) of the first support member 225 and to the second support member 230. At the same time, the pivot slit 420 is inserted through the openings 410, 420 of the mounting rods 235. That is, the first and second support members 225, 230 comprise at least as many cutouts 735 as the number of mounting rods 235. The cutouts 735 of the first support member 225 are substantially collinear with the cutouts 735 of the second support member 230, such that when a first end of the mounting rod 235 is recessed within a cutout 735 of the first support member 225, the second end of that mounting rod 235 is recessed within a collinear cut out 735 of the second support member 230. Each end of the mounting rods 235 includes an opening 310, 315 through the entire width. In certain embodiments, the opening 310, 315 passes through a partially flattened end of the mounting rods 235.

In an open position of the locking bar 405 of the second support member 230, the pivot slits 420 are slid within the narrow channel 520 to a nonvisible location, such that no part of the locking bar 405 is inserted in the second opening 315 of the mounting rod 235. The distance D between the second support member 230 and the bend of the bent end 410 of the locking bar 405 shows that the locking bar 405 is in an open position. By comparison, the substantially zero distance between the first support member 225 and the bend of the bent end 410 of the locking bar 405 shows that the locking bar 405 is in a closed position.

The mounting rods 235 pass through apertures 710 of the mounting pages 720, which hang from the mounting rods 235 when the mounting rods are coupled to the first support member 225 and to the second support member 230.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means for" or "step for" are explicitly used in the particular claim.

What is claimed is:

1. A disaster-safe document binder comprising:

a first cover panel comprising a fire resistant self-extinguishing material;

a second cover panel comprising a self-extinguishing material;

a spine assembly having a spine axis, wherein the spine assembly is disposed between the first cover panel and the second cover panel, the spine assembly rotatably coupled about a spine axis direction to each of the first cover panel and the second cover panel;

a plurality of linear mounting rods coupled to the spine assembly and configured to physically support documents hanging vertically downward from the plurality of linear mounting rods, and each of the linear mounting rods has an opening; and a locking bar configured to be slidably inserted in the spine axis direction inside a channel of the spine assembly to secure the plurality of linear mounting rods, wherein the locking bar consists of a single bar that extends through the openings in all of the linear mounting rods thereby mechanically coupling the linear mounting rods to the spine assembly with the single bar;

each of the spine assembly and the locking bar comprising a locking mechanism aperture, a locking mechanism configured extend through the locking mechanism apertures in the spine assembly and the locking bar to lock the locking bar in a closed position; and wherein a micro-climate environment is formed when the disaster safe document binder is in the closed position.

2. The disaster-safe document binder of claim 1, wherein the self-extinguishing material is covered by a non-flammable material.

3. The disaster-safe document binder of claim 1, further comprising an apron extending along a lower surface of the first cover panel from a first end of the spine assembly to a second end of the spine assembly.

4. The disaster-safe document binder of claim 1, wherein at least one of: the first cover panel, the second cover panel, the spine assembly, a protective rim, the linear mounting rods, or the locking bar comprises a non-rusting metal.

5. The disaster-safe document binder of claim 4, wherein the non-rusting metal is one of: aluminum or a non-ferrous metal.

6. The disaster-safe document binder of claim 1, further comprising a compression seal configured to seal the disaster-safe document binder in the closed position and resist penetration of external air, moisture, and particulates.

7. The disaster-safe document binder of claim 1, further comprising at least one of: a barrier board and buffered silica gel each configured to control a relative humidity and atmospheric pollutants of the micro-climate.

8. The disaster-safe document binder of claim 1, further comprising a latch assembly configured to secure the disaster safe document binder in the closed position.

9. A disaster-safe document binder comprising:

a first cover panel comprising a fire resistant self-extinguishing material;

a second cover panel comprising a self-extinguishing material;

a spine assembly having a spine axis, wherein the spine assembly is disposed between the first cover panel and the second cover panel, the spine assembly rotatably coupled about a spine axis direction to each of the first cover panel and the second cover panel;

a plurality of linear mounting rods coupled to the spine assembly and configured to physically support documents hanging vertically downward from the plurality of linear mounting rods; and a locking bar configured to be slidably inserted in the spine axis direction inside a channel of the spine assembly to secure the plurality of linear mounting rods, each of the spine assembly and the locking bar comprising a locking mechanism aperture, a locking mechanism configured extend through the locking mechanism apertures in the spine assembly and the locking bar to lock the locking bar in a closed position;

wherein a micro-climate environment is formed when the disaster safe document binder is in the closed position; and wherein at least one of the first cover panel, the second cover panel, the spine assembly, a protective rim, the linear mounting rods, or the locking bar comprises a non-rusting metal, the non-rusting metal comprises one of aluminum or a non-ferrous metal, and the non-rusting metal is coated with an electroceramic coating.

10. A disaster-safe document binder comprising:

a first cover panel comprising a self-extinguishing material;

a second cover panel comprising a self-extinguishing material;

a spine assembly having a spine axis, wherein the spine assembly is disposed between the first cover panel and the second cover panel, the spine assembly rotatably coupled about a spine axis direction to each of the first cover panel and the second cover panel;

an apron extending along a lower surface of the first cover panel from a first end of the spine assembly to a second end of the spine assembly;

a plurality of linear mounting rods coupled to the spine assembly and configured to physically support documents hanging vertically downward from the plurality of linear mounting rods; and a locking pin removably inserted in the spine axis direction inside a channel of the spine assembly, and the locking pin consists of a single rod that extends through and secures all of the plurality of linear mounting rods to the spine assembly, each of spine assembly and the locking pin comprises a locking mechanism aperture, a locking mechanism extending through the locking mechanism apertures in the spine assembly and the locking pin to lock the locking pin in the channel; and wherein a micro-climate environment is formed when the disaster safe document binder is in a closed position.

11. The disaster-safe document binder of claim 10, further comprising a latch assembly configured to secure the disaster-safe document binder in the closed position.

12. The disaster-safe document binder of claim 10, wherein at least one of: the first cover panel, the second cover panel, the apron, the spine assembly, a protective rim, the linear mounting rods, the locking pin or a locking bar comprises a non-rusting metal.

13. The disaster-safe document binder of claim 10, further comprising:

a compression seal configured to seal the disaster-safe document binder in the closed position and resist penetration of external air, moisture, and particulates; and a layer of compression material configured to limit an air gap between the documents and at least one of the first cover panel and second cover panel and resist folding of the documents.

14. The disaster-safe document binder of claim 10, further comprising at least one of: a barrier board and buffered silica gel each configured to control a relative humidity and atmospheric pollutants of the micro-climate.

15. A spine assembly for releasably binding documents within a binder, the spine assembly comprising:

mounting rods, each having a pierced first end and a pierced second end;

a "U" channel mounting bracket formed from a single element and configured to receive the mounting rods and mechanically couple to the pierced first and second ends of the mounting rods, the "U" channel mounting bracket having:

a bottom, a first support member oriented substantially perpendicular to the bottom on a first side of the bottom and including a first channel and a first slot configured to receive the pierced first ends of the mounting rods, and a second support member oriented substantially perpendicular to the bottom on another side of the bottom opposite the first side and including a second channel and a second slot configured to receive the pierced second ends of the mounting rods, wherein the first and the second support members are configured to structurally support weight applied to the "U" channel mounting bracket; and a locking assembly configured to slidably receive a locking pin within the first channel, the locking pin consists of a single rod that extends through all of the pierced first ends of the mounting rods thereby mechanically coupling the mounting rods to the "U" channel mounting bracket with the single rod.

16. The spine assembly of claim 15, wherein the "U" channel mounting bracket is configured to rotably couple to each of a front cover panel and a back cover panel through a hinge.

17. The spine assembly of claim 16, wherein the hinge is a piano hinge comprising a hinge leaf having hinge knuckles of a specified length, the hinge knuckles having a hinge pin channel configured to receive a hinge pin of a specified pin diameter, wherein the hinge leaf is coupled to the "U" channel mounting bracket, and wherein the specified length is ½ inch and the specified pin diameter is ⅛ inch.

18. The spine assembly of claim 15, wherein the mounting rods, the "U" channel mounting bracket, and the locking assembly comprise a non-rusting, non-ferrous metal.

19. The spine assembly of claim 15, wherein the locking assembly further comprises a locking mechanism configured to extend directly through and secure the locking pin to the "U" channel mounting bracket, the locking mechanism comprising a via in the first support member configured to:

align with a via in the locking pin, and receive a locking screw oriented orthogonal to the first channel through both the via in the first support member and the via in the locking pin.

20. The spine assembly of claim 15, further comprising a labeling spine mechanically coupled to the "U" channel mounting bracket.

21. The spine assembly of claim 20, wherein the labeling spine comprises at least one of a self-extinguishing core and a non-flammable cover.

* * * * *